United States Patent [19]

Dauenbaugh

[11] 4,099,397

[45] Jul. 11, 1978

[54] SNAP-IN CYLINDER FOR DISC AND PIN TUMBLER CAM LOCKS

[75] Inventor: Robert L. Dauenbaugh, Rockford, Ill.

[73] Assignee: Keystone Consolidated Industries, Inc., Peoria, Ill.

[21] Appl. No.: 811,307

[22] Filed: Jun. 29, 1977

[51] Int. Cl.[2] ..... E05B 9/04

[52] U.S. Cl. ..... 70/371; 70/451

[58] Field of Search ..... 70/367, 368, 370, 371, 70/448, 449, 451

[56] References Cited

U.S. PATENT DOCUMENTS

| | | | |
|---|---|---|---|
| 1,797,725 | 3/1931 | Jacobi | 70/368 |
| 2,255,402 | 9/1941 | Vile | 70/367 |
| 2,476,458 | 7/1949 | Schoepe | 70/367 |
| 2,480,026 | 8/1949 | Jacobi | 70/368 |
| 2,744,185 | 5/1956 | Cawley | 70/370 |

*Primary Examiner*—Robert L. Wolfe

*Attorney, Agent, or Firm*—Allegretti, Newitt, Witcoff & McAndrews

[57] ABSTRACT

An improved lock assembly includes a sleeve which is attached to a drawer or door by an original equipment manufacturer of desks, cabinets or the like. A cylinder lock may be installed in the sleeve by insertion in the sleeve with a retainer member. The retainer member includes a tab cooperative with a slot in the lock and an arm which projects through a slot in the sleeve to engage a tang on the sleeve that holds the retainer sleeve and lock together in assembly.

14 Claims, 7 Drawing Figures

10
12
14
15
16
18
20
22
24
26
28
30
32
34
36
38
40
42
44
46
48
50
56
58
60
62
64
66
67
68
69
70
74
76
78
80
84
86
88
90
92
93
93A
94
96
97
98
100
102
104
106
108
110

DRAW
TRAY
L.H. DOOR
R.H. DOOR
10
16
22
94

10
12
15
16
18
20
26
36
60
66
67
88

SNAP-IN CYLINDER FOR DISC AND PIN TUMBLER CAM LOCKS

BACKGROUND OF THE INVENTION

This invention relates to an improved lock assembly and more particularly to a lock assembly of the type including a removable and replaceable key operated cylinder lock of either pin tumbler or disc tumbler design.

Original equipment manufacturers of desks, cabinets and similar equipment which incorporate locked doors or drawers generally require a complete lock inventory. The inventory is required, since the locks are installed at the site of original manufacture of the product. If a lock fails or in the event a lock must be changed, an end user will rely on the original equipment furniture manufacturer to provide a replacement lock or parts from the manufacturer's inventory. Such inventory is an expensive overhead item and would desirably be eliminated by the original equipment manufacturer.

To accomplish this objective, it has been suggested that the original equipment manufacturer of desks and the like mount only a sleeve assembly for a cylinder lock in the furniture. The furniture with the attached sleeve assembly can then be shipped to an ultimate user who would also be provided with a cylinder lock by either the O.E.M. or the lock manufacturer for installation in the sleeve assembly. Additional keys, cylinder locks or replacement therefor would, however, be obtained directly from the lock manufacturer. As a result, the original equipment manufacturer of the desk would no longer need to maintain a large replacement and repair inventory of locks and keys. Rather, the lock manufacturer, having expertise in the field of locks and keys, could be relied upon for repair and replacement of cylinder locks and keys.

To accomplish these objectives, it is necessary to provide a sleeve assembly cooperative with any type of cylinder lock. That is, the sleeve assembly must cooperate with disc tumbler cylinder locks as well as pin tumbler cylinder locks. Additionally, the sleeve assembly should be easily mountable in a desk, drawer, cabinet or other lockable container panel. Likewise, the lock assembly should be useful with strikes positioned in any desired relation relative to the bolt of the lock assembly. The cylinder lock should also be easily removable from the lock assembly without a requirement for special tools so that the end user can easily replace the cylinder lock if necessary.

Various structures to accomplish some of these objectives are suggested by prior art patents including the following list of patents:

| Pat. No. | Title | Inventor |
|---|---|---|
| 1,544,951 | Lock | Sollee |
| 1,777,725 | Cylinder Lock | Hines |
| 1,797,725 | Lock | Jacobi |
| 1,934,327 | Locking Device for Pump Shafts and the Like | Ridder |
| 2,021,996 | Lock | Jacobi |
| 2,268,511 | Removable Lock Core | Ledin |
| 2,292,515 | Tumbler Lock | George |
| 2,370,862 | Removable Core Cylinder | Johnstone |
| 2,476,458 | Door Lock | Schoepe |
| 2,480,026 | Lock | Jacobi |
| 2,610,500 | Lock Retainer | Poupitch |
| 2,744,185 | Illuminated Knob | Cawley |
| 2,767,570 | Coin-Controlled Locker | Garver |
| 2,948,141 | Means for Retaining a Lock Cylinder in a Panel | Vahlstrom |

-continued

| Pat. No. | Title | Inventor |
|---|---|---|
| 3,068,682 | Padlock with Dual Blockers | Russell et al |
| 3,190,092 | Cylinder Lock Housing | Patriquin |
| 3,402,582 | Cylinder Lock with Improved Retainer | Jacobi |
| 3,434,316 | Removable Lock Cylinder Mechanism | Neary |
| 3,824,817 | Removable Cylinder Locks | Orr |
| 4,012,928 | | |
| S.N. 662,153 | Cylinder Retention Mechanism | Dauenbaugh |

The subject matter of the present invention contemplates improved results over the various prior art references and further contemplates accomplishing, by means of a single unit, all the objectives discussed above.

SUMMARY OF THE INVENTION

The present invention of a lock assembly includes a generally cylindrical sleeve adapted to be received by an opening in a drawer panel or the like. A sleeve retainer slidably engages the sleeve and holds it in the opening provided therefor in the drawer.

A slot extends through the cylindrical sleeve. A shifter mechanism is positioned within the sleeve and is operated by a cylinder lock retained by a lock retainer that engages the cylinder lock, extends through slot of the sleeve and fastens to the sleeve. Access to the lock retainer is provided on the inside of the door or drawer so that the retainer may be unlocked to release the cylinder lock for repair or replacement.

The shifter is keyed to a bolt. Rotation of a key operates the shifter and bolt. The bolt is adjustable relative to the shifter to provide for left-hand, right-hand, drawer or tray movement.

It is thus an object of the present invention to provide an improved lock assembly, particularly one adapted to receive a replaceable cylinder lock.

Still a further object of the present invention is to provide a lock assembly which may be easily incorporated into a door or drawer panel by an original equipment manufacturer.

A further object of the present invention is to provide a lock assembly having a bolt adapted to be positioned in any one of a number of directions.

One further object of the present invention is to provide a lock assembly wherein a pin tumbler or a disc tumbler cylinder lock may be utilized to operate the bolt of the assembly.

Another object of the present invention is to provide a lock assembly which is easy to assemble and inexpensive.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
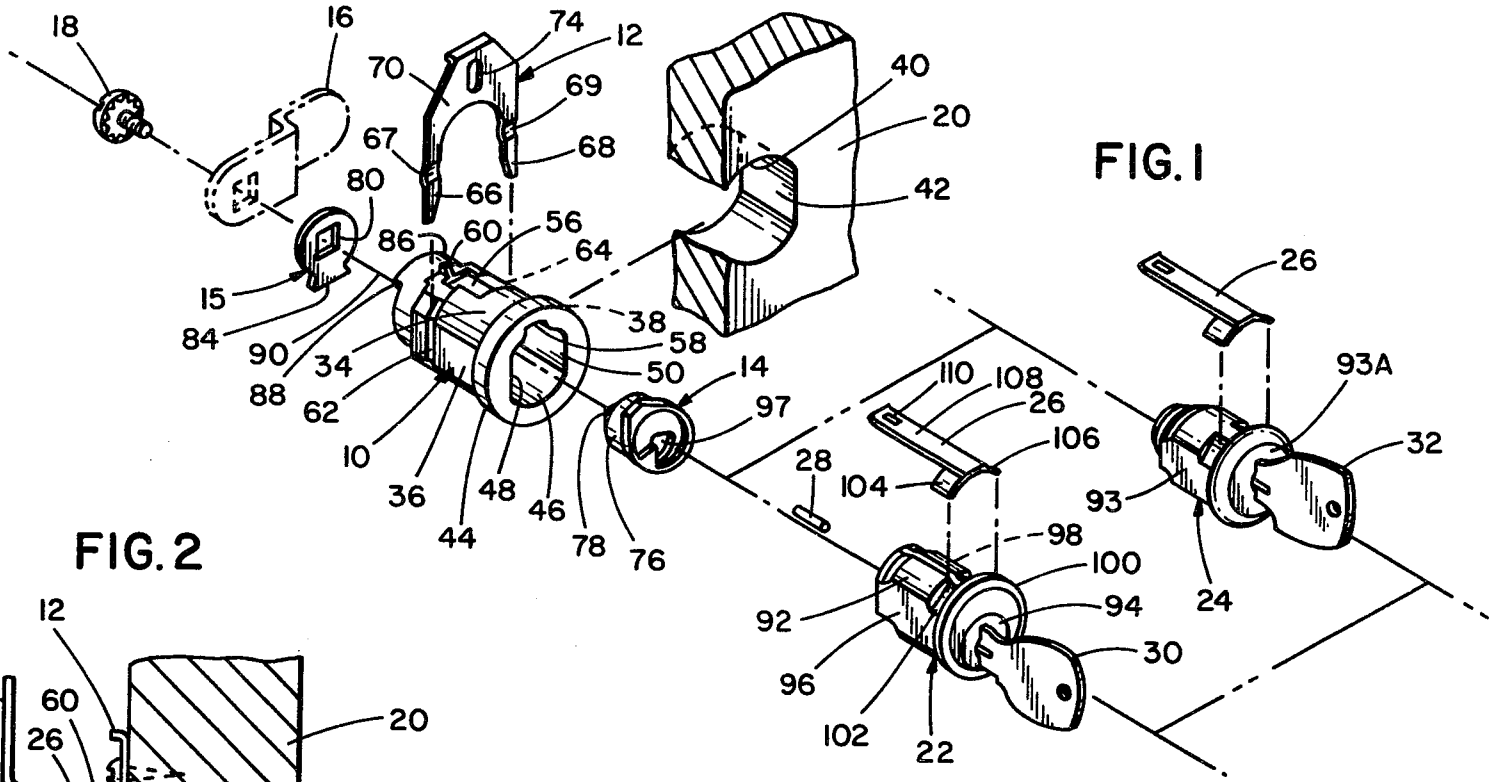
FIG. 1 an exploded perspective view illustrating the various component parts of the improved lock assembly of the present invention.

FIG. 1 illustrates the principal components in the lock assembly of the present invention. Typically, an original equipment manufacturer will install the indicated sleeve subassembly. The sleeve subassembly includes a sleeve 10 cooperative with a sleeve retainer 12. A shifter 14 is positioned within the sleeve 10 and projects through cam stop 15 for attachment to bolt 16 by means of screw 18. This subassembly is positioned within a drawer or door panel 20 at the factory site.

Subsequently, the lock subassembly may be installed. The lock subassembly includes either a pin tumbler lock 22 or a disc tumbler lock 24 retained within sleeve 10 by means of a lock retainer 26. An optional lug 28 may be incorporated with the pin tumbler lock 22 as discussed in further detail below. Keys 30 and 32 are, of course, removable from their respective locks 22 and 24.

Referring to the remaining figures then, each of the separate components will be described as well as their relationship to each other. The sleeve 10 is generally cylindrical. Outside surface 34 of sleeve 10 includes flats 36 and 38 which cooperate with flats, as at 42, in the opening 40 of panel 20. That is, flat 38 cooperates with flat 42 to prevent rotation of the sleeve 10 in the opening 40. A circumferential flange 44 is provided at the outside end of the sleeve 10. The flange 44 cooperatively engages the front surface of panel 20. The sleeve 10 includes a passage or opening 46 therethrough. The opening 46 is generally cylindrical except for opposed plane surfaces 48 and 50 which cooperate with the pin tumbler lock 22 or disc tumbler lock 24 to prevent rotation of those locks in the opening 46.

At the inside end of the sleeve 10, the opening 46 is reduced in size to define a circular passage 54 of lesser diameter and with a bearing surface 52. A rectangular slot 56 extends through the side wall of the sleeve 10 at the inside end. The rectangular slot 56 connects with a longitudinal recess 58 on the inside surface of opening 46. At the inside end of the sleeve 10 adjacent the slot 56 is an upwardly projecting tang 60.

Astride the slot 56 and transverse thereto is at least one set of parallel slots 62, 64. The slots 62, 64 cooperate with sleeve retainer 12. The sleeve retainer 12 includes bifurcated arms 66 and 68 which are spaced by the connecting yoke 70 an appropriate distance so that they may cooperatively engage the slots 62 and 64 respectively.

Figure 2:
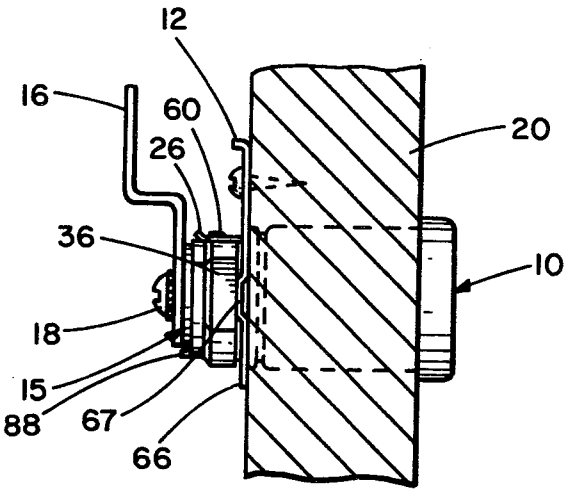
FIG. 2 a side view of the lock assembly of the present invention.
Figure 4:
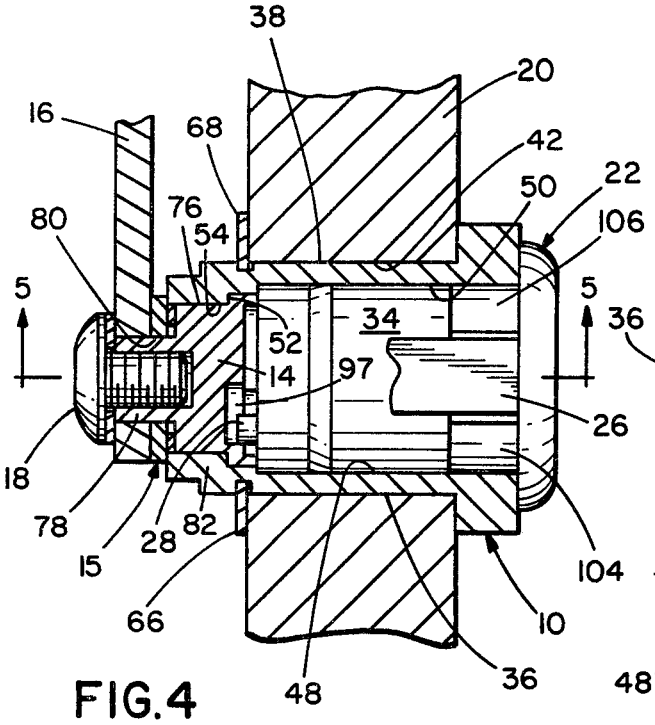
FIG. 4 a top plan view of the improved lock assembly of the present invention.
Figure 6:
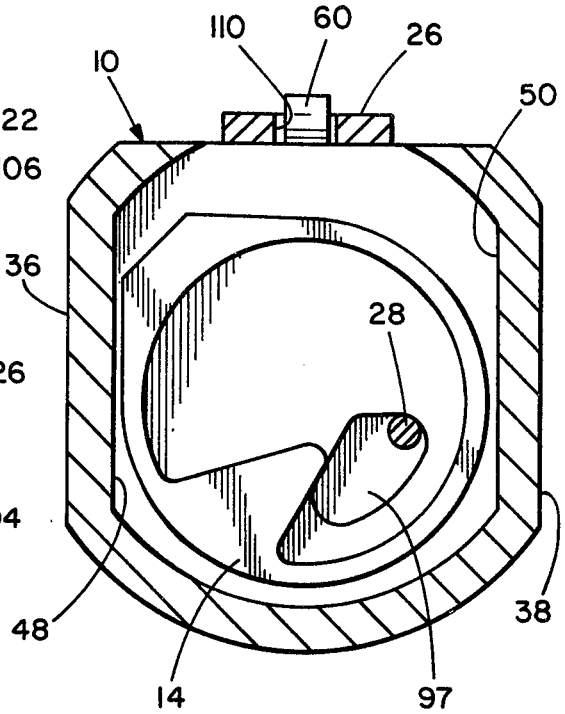
FIG. 6 a cross-sectional view taken along the line 6—6 in FIG. 5.
Figure 5:
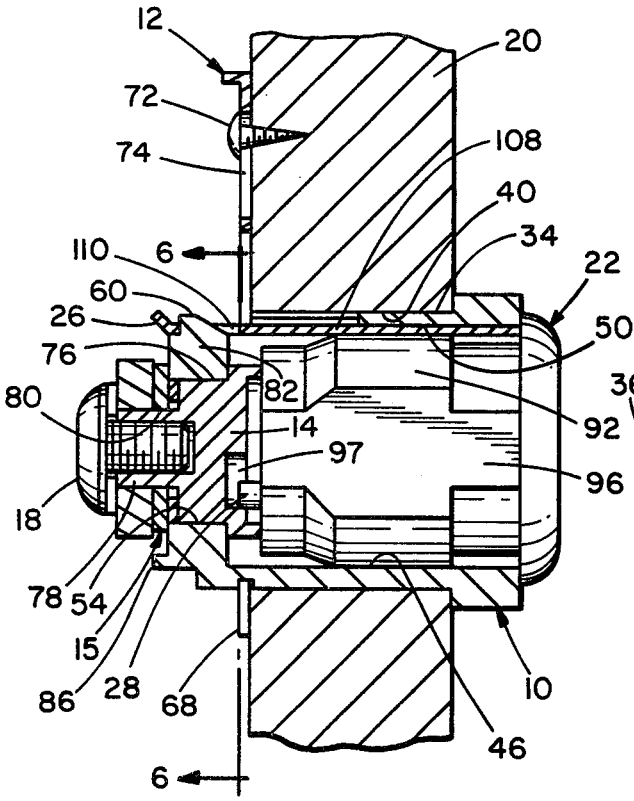
FIG. 5 a side cross-sectional view of the lock assembly taken along the line 5—5 in FIG. 4.

Thus, the sleeve 10 may be inserted into the opening 40. Flange 44 prevents the sleeve 10 from passing through the opening 40. After the sleeve retainer 12 is positioned on the sleeve 10, as shown in FIG. 2, a screw 72 is attached to panel 20 through an opening 74 in the yoke 70 to retain retainer 12 on panel 20 and thereby retains the sleeve 10 in the panel 20.

The arms 66 and 68 of retainer 12 include detent portions 67 and 69 which cooperate with the sides of the slots 62 and 64 respectively to frictionally retain the arms 66 and 68 in the slots 62, 64. It is also noted that the sleeve retainer 12 is slightly flexible and thus provides a spring tension against the inside surface of panel 20 to thereby more securely retain the sleeve 10 within the opening 40.

The shifter 14 sits within the center opening 46 in sleeve 10 having centerline axis 90. Shifter 14 includes a stub 76 which projects through the opening or passage 54. A rectangular stud 78 projects from stub 76. Stud 78 cooperates with a rectangular opening 80 in cam stop 15. The cam stop 15 and shifter 14 thus sandwich the end wall 82 defining the opening 54 in sleeve 10. Cam stop 15 includes a projecting cam 84 which cooperates with stops 86 and 88 on sleeve 10 to limit rotation of the shifter 14 and the components attached to the shifter 14.

Bolt 16 is attached to the stud 78 and thus to the shifter 14 by means of screw 18. The shifter 14, cam stop 15, bolt 16 and screw 18 all rotate in unison about the centerline rotation axis 90 for the sleeve 10.

Figure 3:
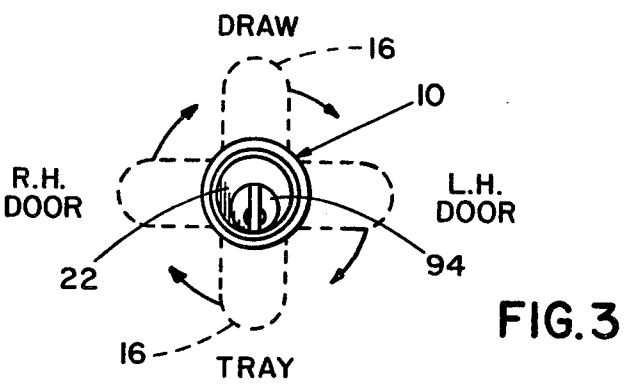
FIG. 3 a front view of an assembled lock assembly of the present invention illustrating alternative bolt positions.

As illustrated in FIG. 3, the bolt 16 may be positioned on the stud 78 in any one of four positions to accomodate a right-hand door, a left-hand door, a tray arrangement or a drawer arrangement. Similarly, the stop cam 15 may be positioned on stud 78 to control the rotation of the bolt 16 as required for the particular lock application.

The total sleeve subassembly so far described is, as previously mentioned, installed at the factory where the cabinets or doors are made. Subsequently, after finishing and shipment of the goods to the end user, the lock subassembly now described may be inserted or replaced in the factory installed subassembly.

Again, referring to figures, typically a pin tumbler lock 22, which is operated by a key 30, is inserted in sleeve 10. The pin tumbler lock 22 is comprised of a plug 94 and cylinder 92 with a pin tumbler mechanism of the type known to those skilled in the art. The cylinder 92 includes flat sides 96 and 98 cooperative with sides 48 and 50 of sleeve 10 to prevent rotation of the cylinder 92 when the lock 22 is assembled with the sleeve. A flange 100 at the front end of the cylinder 92 cooperates with the flange 44 of sleeve 10 to provide a furnished look and also to limit insertion of cylinder 92 within the sleeve 10. A circumferential slot 102 is defined in the surface of cylinder 92. Slot 102 receives tabs or arms 104 and 106 of lock retainer 26.

Lock retainer 26 also includes a longitudinal spring arm 108 which fits within groove or recess 58 and projects through slot 56. Opening 110 at the end of the spring arm 108 engages the tang 60 of sleeve 10 to hold the retainer 26 and thus the lock 22 in position within the sleeve 10. Note that the cooperative opening 110 and tang 60 are inward of the inside surface of panel 20. Thus, the retainer 26 and more particularly the spring arm 108 may be detached from tang 60 for release and replacement of lock 22.

Disc tumbler lock 24 may be substituted for pin tumbler lock 22. Disc tumber lock 24 includes a slot 102A in a cylinder 93 cooperative with a retainer 26 in substantially the identical manner as retainer 26 cooperates with slot 102 of lock 22. Disc tumbler lock 24 also includes a plug 93A operated by key 32.

Figure 7:
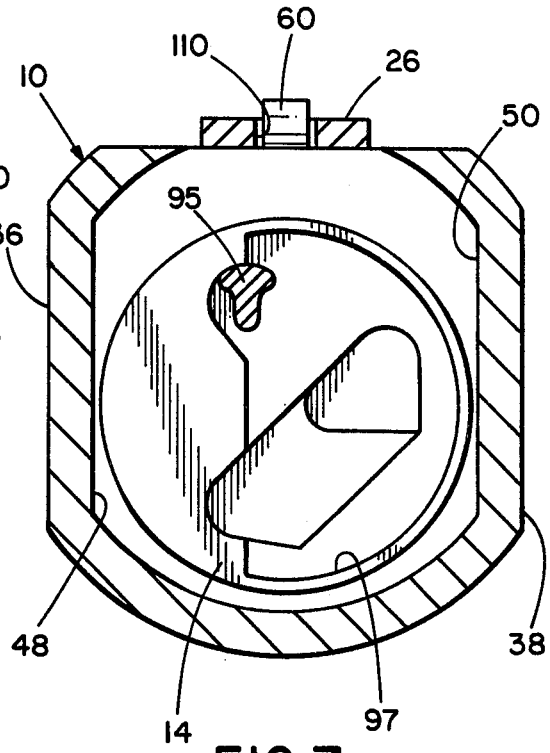
FIG. 7 is a cross-sectional view similar to FIG. 6 illustrating an alternative embodiment of the invention.

It is possible to vary the structure and assembly of the device herein described. A lug or pin 28 may, for example, be incorporated at the back side of the plug 94. That is, plug 94 and plug 93 include an integral driving lug 95 in FIG. 7 which cooperatively engages recess 97 of shifter 14 to drive shifter 14 and thus the bolt 16. Incorporating pin 28 in plug 94 with lug 95 provides a pin tumbler lock assembly which, though freely rotatable upon insertion of a key, permits removal of the key only when the bolt has been rotated to the locked position.

Thus, while in the foregoing there has been set forth a preferred embodiment of the invention, it is to be understood that the invention shall be limited only by the following claims and their equivalents.

What is claimed is:

1. An improved lock assembly including a removable cylinder lock comprising, in combination:

a sleeve including a centerline axis, an inside end, and outside end and a generally cylindrical opening therethrough with a radial slot from the opening through the side of said sleeve;

a shifter in the opening rotatable about the axis of the sleeve;

a bolt attached to the shifter at the inside end of the sleeve and projecting to engage a strike;

a key operated cylinder lock positioned in the sleeve opening from the outside end including a projecting drive member for engaging and driving the shifter about the axis; and a removable, lock retainer member having one end engaged to the lock with the opposite end projecting through the radial slot and engaging the sleeve at the inside end.

2. The improved assembly of claim 1 wherein said cylinder lock includes at least one circumferential slot and said retainer member includes a tab projecting into said slot to retain said cylinder lock.

3. The improved assembly of claim 1 wherein said sleeve includes a locking tab at the inside end and said lock retainer member includes an opening cooperative with the sleeve locking tab to hold the lock retainer and lock in position within the sleeve.

4. The improved lock assembly of claim 1 wherein said lock retainer member includes a first arm cooperatively engaging the lock and a second spring biased arm cooperatively engaging the sleeve whereby the retainer member retains the lock within the sleeve in response to the spring bias locking action of the lock retainer member.

5. The improved assembly of claim 1 wherein said lock is retained in non-rotative position in the sleeve opening.

6. The improved lock assembly of claim 1 wherein said sleeve includes at least one keying surface for keyed interaction with a cooperative opening in a drawer panel.

7. The improved assembly of claim 1 including a sleeve retainer cooperatively engaging said sleeve to hold said sleeve in position within an opening in a drawer panel.

8. The improved assembly of claim 7 wherein said sleeve retainer comprises a bifurcated retainer member cooperative with opposed slots in the side of said sleeve, said sleeve also including a circumferential flange about the outside end thereof whereby the sleeve is retained in a drawer panel by insertion through the opening in a panel and attachment of the sleeve retainer into the slots.

9. The improved assembly of claim 8 wherein said sleeve retainer imparts a biasing force against the drawer panel.

10. The improved assembly of claim 1 including means on the sleeve and shifter cooperative to limit the amount of axial rotation of the shifter with respect to the sleeves.

11. The improved assembly of claim 1 wherein the cylinder lock is a pin tumbler cylinder lock operative in response to a key.

12. The improved assembly of claim 1 wherein the cylinder lock is a pin tumbler cylinder lock operated by a key which may be removed from the lock only when the bolt is placed in the locked position.

13. The improved assembly of claim 1 wherein said cylinder lock comprises a disc tumbler lock.

14. The improved assembly of claim 1 wherein said shifter is adapted to receive said bolt in a plurality of keyed positions.

* * * * *